United States Patent [19]

Miyata et al.

[11] Patent Number: 4,998,073

[45] Date of Patent: Mar. 5, 1991

[54] WAKE FIELD ACCELERATOR

[75] Inventors: Kenji Miyata; Masatsugu Nishi, both of Katsuta, Japan

[73] Assignee: Hitachi, Ltd., Tokyo, Japan

[21] Appl. No.: 362,923

[22] Filed: Jun. 8, 1989

[30] Foreign Application Priority Data

Jun. 10, 1988 [JP] Japan ..... 63-141734

[51] Int. Cl.[5] ..... H05H 9/00

[52] U.S. Cl. ..... 328/233; 315/5.12; 328/230

[58] Field of Search ..... 328/232, 230; 315/5, 315/5.11, 5.12, 5.51

[56] References Cited

PUBLICATIONS

"The NRL Autoaccelerator Concept", IEEE Transactions on Nuclear Science, vol. NS-26, No. 3, Jun. 1979, pp. 4237 & 4238.

"On Collinear Wake Field Acceleration", IEEE Transactions on Nuclear Science, vol. NS-32, No. 5, Oct. 1985, pp. 3524 & 3525.

*Primary Examiner*—Kenneth Wieder

*Attorney, Agent, or Firm*—Antonelli, Terry, Stout & Kraus

[57] ABSTRACT

A wake field acceleator in which a current to be formed by a driving charged particle bunch that excites a wake field is controlled so as to compensate a Joule heat loss on the wall surface of a cavity constituting the wake field accelerator, and to subject the driving charged particle bunch to a substantially uniform deceleration voltage. With the wake field accelerator, the maximum transformer ratio can be realized with a small beam length of the driving charged particle bunch, and an energy extraction efficiency of approximately 100% can be realized.

20 Claims, 7 Drawing Sheets

WAKE FIELD ACCELERATOR

BACKGROUND OF THE INVENTION

The present invention relates to a linear accelerator for accelerating charged particles, and more particularly to a wake field accelerator which is a high gradient linear accelerator well suited to the miniaturization of the whole accelerator.

The basic idea of a wake field accelerator, which is in the limelight as a high gradient linear accelerator of the next generation, is traced back to an automatic accelerator by M. Friedman (Naval Research Laboratory in U.S., 1973). A "wake field" is a transient electromagnetic field which is established by the electromagnetic interaction between a bunch of charged particles and a conductor wall surrounding them and which remains behind the bunch of charged particles. In the present invention, a voltage generated in the wake field shall be called a "wake field voltage". The "wake field accelerator" is an apparatus in which a bunch of charged particles in a small number (hereinbelow, termed "charged particle bunch to-be-accelerated)" that succeed a bunch of charged particles having excited the wake field (hereinbelow, termed "driving charged particle bunch)" are accelerated by a high electric field owned by the wake field. Important factors which govern the performance of the wake field are a transformer ratio R and an energy extraction efficiency $\eta$.

The "transformer ratio" is the ratio of the maximum acceleration voltage which the charged particle bunch to-be-accelerated undergoes, to the maximum deceleration voltage which the driving charged particle bunch undergoes at the wake field voltage. As the transformer ratio R is higher, the relative ability of the high field acceleration rises more.

On the other hand, the "energy extraction efficiency" indicates the proportion of energy by which the driving charged particle bunch has actually excited the wake field, to the maximum excitation energy which can be stored in the wake field. The energy by which the driving charged particle bunch excites the wake field, is equal to the sum of energies which individual driving charged particles lose due to deceleration voltages $V_m(t)$ induced in the wake field by the driving charged particle.

The, maximum excitation energy is energy which is stored in the wake field when the individual charged particles are decelerated by the maximum deceleration voltage $V_m^-$ realizable in the wake field. Accordingly, the energy extraction efficiency $\eta$ is evaluated by the following equation:

$$\eta = \frac{\left| \int_{-\infty}^{T} I(t)V_m(t)dt \right|}{\left| V_m^- \int_{-\infty}^{T} I(t)dt \right|} \tag{1}$$

Here, I(t): current formed by the driving charged particle bunch at a time t, $V_m(t)$: deceleration voltage in the wake field at the time t, $V_m^-$: maximum deceleration voltage which the driving charged particle bunch undergoes.

Accordingly, wake field accelerator of favorable energy extraction efficiency is an accelerator which can form the maximum deceleration voltage quickly and which can thereafter maintain it so as to decelerate the driving charged particles.

An example of a wake field accelerator of high transformer ratio and high energy extraction efficiency is a wake field accelerator by K. L. F. Base et al., which descended from the autoaccelerator by M. Friedman. It is detailed in "SLAC-PUB 3662 (Apr. 1985)" which is the research report of Stanford Linear Accelerator Center in the U.S. Here, Base's wake field accelerator will be briefly explained.

A bunch of electrons are processed so as to excite a wake field and a bunch of electrons to be accelerated are caused to travel along the center axis of an axially-symmetric cavity. On this occasion, current I(t) formed by the driving electron bunch which is caused to flow for a time interval T is changed as indicated by the following equation:

$$I(t) = I_1(t) = \begin{cases} I_0\omega t & (\text{for } 0 \leqq t \leqq T) \\ 0 & (\text{for } t > T) \end{cases} \tag{2}$$

or $$I(t) = I_2(t) = \begin{cases} I_0 & \left(\text{for } -\frac{\pi}{2\omega} \leqq t \leqq 0\right) \\ I_0(1 + \omega t) & (\text{for } 0 \leqq t \leqq T) \\ 0 & (\text{for } t > T) \end{cases} \tag{3}$$

Here, $I_o$: constant, $\omega$: resonant angular frequency of the fundamental mode of the cavity.

The situation of the time-variation of a wake field voltage V(t) on the center axis of the cavity as based on the wake field excited on this occasion, is illustrated in FIG. 2(1) or FIG. 2(2). A broken line in the figure denotes the current I(t). As illustrated in FIG. 2(1) or FIG. 2(2), the wake field voltage V(t) takes minus values and acts as a deceleration voltage for $0 \leqq t \leqq T$. That is, the electron bunch exciting the wake field or the driving electron bunch is decelerated at all times. In consequence, the electron bunch always continues to supply energy to the wake field, and the wake field continues to grow every moment.

In the prior art, the Joule heat loss of an electromagnetic field on the conductor wall surface of the cavity is not taken into account. With the prior art, it is asserted that the transformer ratio R becomes:

$$R = \begin{cases} \omega T/2 & (\text{for } I(t) = I_1(t)) \\ \omega T & (\text{for } I(t) = I_2(t)) \end{cases} \tag{4}$$

thereby increasing without limitation in proportion to the time interval T. Due to the Joule heat loss of the electromagnetic field on the conductor wall surface of the cavity, however, energy is lost, and the energy imparted by the driving electron bunch is not entirely stored in the wake field. Accordingly, letting $n = \gamma T$ (where $\gamma$ denotes an attenuation factor which is based on the finite conductivity of the cavity, and which becomes $$\gamma = \frac{\omega}{2Q}$$

in terms of the Q-value of the cavity), the actual transformer ratio R is approximately given by:

$$R = \frac{1 + 2Qn}{1 + n} \quad (5)$$

and it becomes saturated to R=2 Q for n→∞. The n-dependency of the transformer ratio R is illustrated in FIG. 3(1). In addition, n can be expressed an n=

$$\left(\frac{\pi}{\lambda Q}\right)c \cdot T$$

in terms of the velocity of light c and a wavelength λ because $\omega = 2\pi c/\lambda$ holds. Here, c·T corresponds to the beam length of the driving electron bunch. Therefore, a small value of the quantity n signifies that the required beam length of the driving electron bunch is short.

On the other hand, the energy extraction efficiency η is higher at $I(t)=I_2(t)$ than at $I(t)=I_1(t)$ and is approximately given by:

$$\eta = \frac{3 + 2n}{3(1 + n)} \quad (6)$$

With the prior art, it is asserted that, for $$n \gtrsim \frac{2\pi\gamma}{\omega}$$

(that is, $$T \gtrsim \frac{2\pi}{\omega}$$

where a wavy line signifies "nearly equal)", the energy extraction efficiency η is substantially 100% irrespective of n. Also here, however, the deceleration voltage $V_m(t)$ in FIG. 2(2) does not behave as indicated by a solid line, but rather as indicated by a broken line, on account of the Joule heat loss on the wall surface of the cavity. Accordingly, the energy extraction efficiency η defined by Eq. (1) is expressed by Eq. (6), and it gradually lowers down to a value of 66.7% for n>1. The n-dependency of the energy extraction efficiency η is illustrated in FIG. 3(2).

As stated above, the prior art has the problem that, since the Joule heat loss on the wall surface of the cavity is not considered, actually the transformer ratio R and the energy extraction efficiency η decrease. The second problem ascribable to the Joule heat loss on the wall surface of the cavity is that, when the time interval T for which the current is caused to flow is lengthened, the energy extraction efficiency η lowers cover though the transformer ratio R increases.

SUMMARY OF THE INVENTION

The first object of the present invention is to provide a wake field accelerator in which the transformer ratio R can be enhanced. The second object is to provide a wake field accelerator in which the energy extraction efficiency η can be set high. The third object is to provide a wake field accelerator in which both the transformer ratio R and the energy extraction efficiency η can be enlarged.

The above objects are accomplished by compensating a Joule heat loss on the wall surface of a cavity, and controlling current which is formed by a driving charged particle bunch, so that the driving charged particle bunch may undergo a substantially uniform deceleration voltage.

In order that the driving charged particle bunch, namely, a charged particle bunch exciting a wake field may undergo the uniform deceleration voltage, is provided a method which controls a current waveform so as to initially increase the current of the driving charged particle bunch abruptly and to subsequently render the rate of the increase slow.

Alternatively, there is a method in which the current waveform of the charged particle bunch is set as an exponential saturation shape. For example, the current to be formed by the driving charged particle bunch is varied with time as follows:

$$I(t) = \begin{cases} I_0 & \left(\text{for } -\frac{\pi}{2\omega} \leqq t \leqq 0\right) \\ I_0\left[1 + \frac{\omega}{\gamma}(1 - e^{-\gamma t})\right] & (\text{for } 0 \leqq t \leqq T) \\ 0 & (\text{for } t > T) \end{cases} \quad (7)$$

The operation of the present invention will be described in conjunction with the example of Eq. (7) mentioned above.

FIGS. 4(1) and 4(2) are model diagrams of a cavity. A driving charged particle bunch 51 establishes a magnetic field 52 in a plane perpendicular to the traveling direction thereof, and the magnetic field 52 establishes an electric field 53 in a direction opposite to the traveling direction 54 of the driving charged particle bunch 51, and the electric field 53 also establishes a magnetic field 52. The electromagnetic field grows up according to the amount of passage of the driving charged particle bunch 51 as illustrated in FIG. 4(1). When a certain period of time (γT=5 or so in Eq. (8) to be mentioned below) lapses, the electromagnetic field is substantially saturated at a fixed intensity as illustrated in FIG. 4(2). When the driving charged particle bunch 51 has passed, the electromagnetic field begins to oscillate at the resonant angular frequency ω of a wake field accelerator. Assuming that the Q-value of the wake field accelerator is large, the variation of a wake field voltage which is formed by the aforementioned electric field can be expressed as follows by the use of the complex notation V(t):

$$V(t) = -2RI_0\nu(t) \quad (8)$$

-continued $$v(t) = \begin{cases} \frac{1}{\omega}[\cos\omega t + j(1 + \sin\omega t)] & \left(\text{for } -\frac{\pi}{2\omega} \leqq t \leqq 0\right) \\ \frac{1}{\omega}\left(\frac{1+\epsilon}{1+\epsilon^2}\right) + \frac{j}{\gamma}\left(\frac{1+\epsilon}{1+\epsilon^2} e^{-\gamma t}\right) & (\text{for } 0 \leqq t \leqq T) \\ v(T)\, e^{j\omega(t-T)} & (\text{for } t > T) \end{cases}$$

Here, $\epsilon = \frac{\gamma}{\omega} = \frac{1}{2Q}$ holds. An actual acceleration voltage V(t) is the real part of the wake field voltage V(t) in the complex notation as indicated by Eq. (8). The situation of the time-variation of the wake field voltage V(t) is depicted in FIG. 1. The driving charged particle bunch is formed so as to compensate the Joule heat loss of the electromagnetic field on the wall surface of the cavity. As illustrated in the figure, therefore, the wake field voltage V(t) takes a fixed minus value for $0 \leqq t \leqq T$, so that the electron bunch forming a current I(t) undergoes the fixed deceleration voltage while exciting the wake field. Accordingly, an energy extraction efficiency $\eta$ on this occasion becomes substantially 100% for a time interval $$T > \frac{10}{\omega}$$

for which a transient influence during $$-\frac{\pi}{2\omega} \leqq t \leqq 0$$

is negligible. The time interval T is longer than $$\frac{4\pi}{\omega}$$

in FIGS. 2(1) and 2(2), and is sufficient in practical use. On the other hand, the transformer ratio R of the wake field accelerator is approximately given as follows by the use of $n = \gamma T$:

$$R = 2Q(1 - e^{-n}) \tag{9}$$

In comparison with the prior-art example shown in FIGS. 3(1) and 3(2), the n-dependencies of the transformer ratio R and the energy extraction efficiency $\eta$ are respectively illustrated in FIGS. 5(1) and 5(2).

FIG. 5(1) indicates that a high transformer ratio can be attained even when the quantity n is small, that is, when the beam length of the driving charged particle bunch is small. Besides, FIG. 5(2) indicates that, even when the beam length of the driving charged particle bunch is increased for heightening the transformer ratio, the energy extraction efficiency does not lower and can be kept substantially at 100%. Thus, according to the present invention, the transformer ratio is as high as 2Q (in the order of $10^4$) at the energy extraction efficiency of 100%, so that an acceleration at an ultrahigh accelerating gradient of 1 GeV/m is realized with a current of several tens kA, and the length of the wake field accelerator can be reduced.

DETAILED DESCRIPTION OF THE PREFERRED EMBODIMENTS

Figure 6:
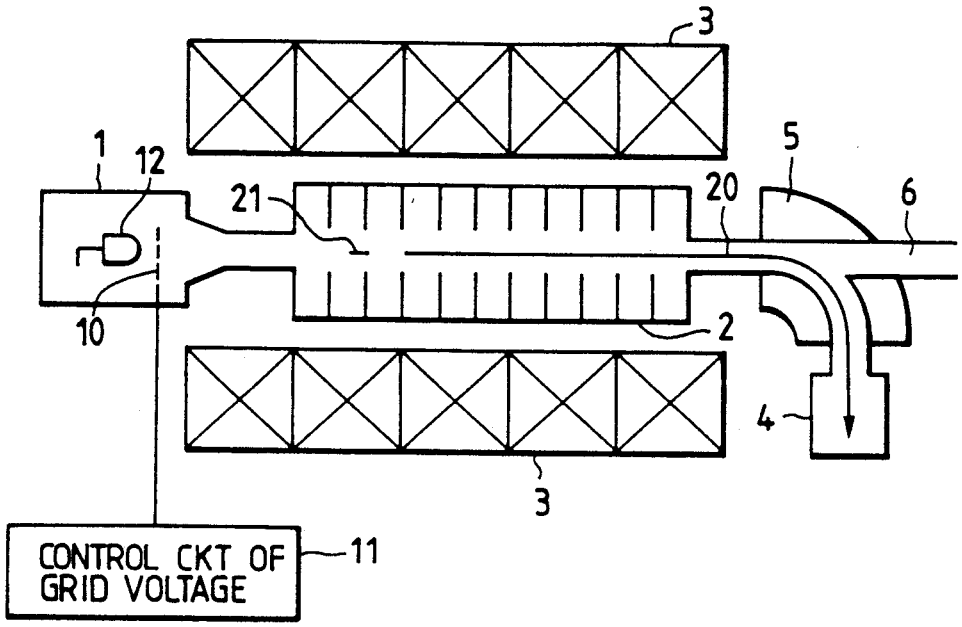
FIGS. 6 thru 11 are transverse sectional views of apparatuses each illustrating an embodiment of the present invention.

Now, an embodiment of the present invention will be described with reference to FIG. 6.

An electron gun 1 which includes a cathode 12 and a grid electrode 10 for controlling a current, a cavity 2 in which a wake field is generated, a focusing coil assembly 3 which serves to focus an electron beam, a collector 4 for the electron beam, a bending magnet 5, and a port 6 for deriving high energy electrons. A control circuit 11 for a grid voltage is connected to the grid electrode 10 included in the electron gun 1. The operation of this embodiment will be described on the basis of the above construction.

Figure 1:
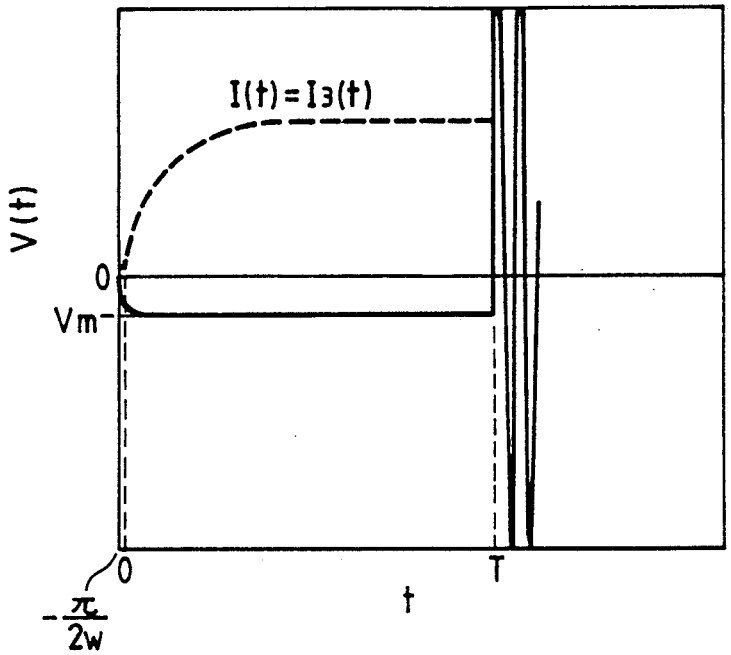
FIG. 1 is a diagram showing a phenomenon on which the present invention is based.
Figures 1, 4:
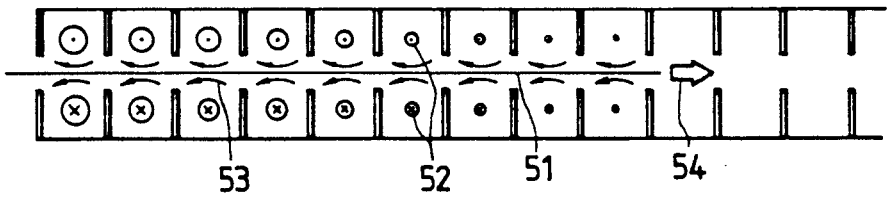
FIGS. 4(1) and 4(2) are model diagrams of a cavity.
Figures 2, 4:
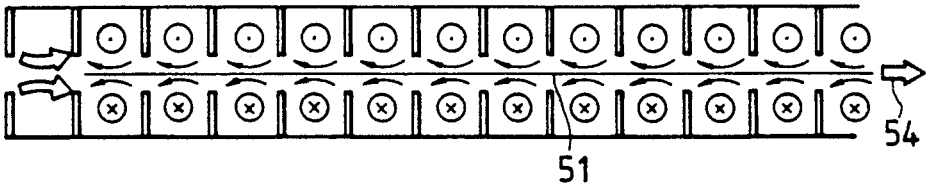
FIGS. 2(1) and 2(2) are diagrams showing phenomena in the prior art.
Figures 1, 2:
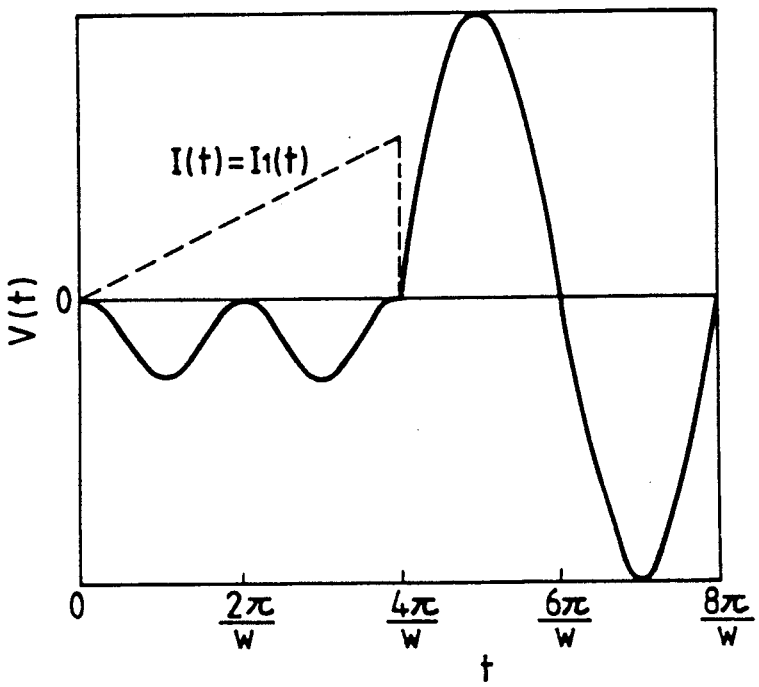
FIG. 2-1 (PRIOR ART)
Figure 2:
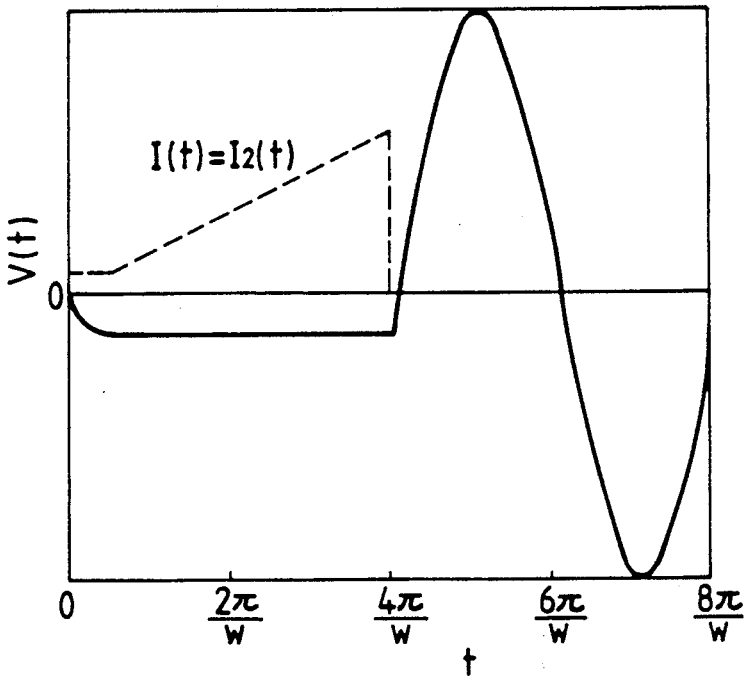
FIG. 2-2 (PRIOR ART)
Figures 1, 3:
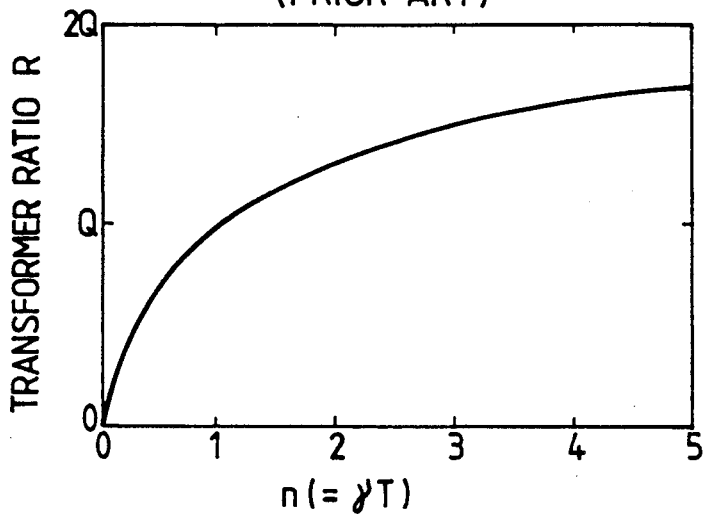
FIG. 3-1 (PRIOR ART)
FIGS. 3(1) and 3(2) are diagrams showing the characteristics of the prior art.
Figures 2, 3:
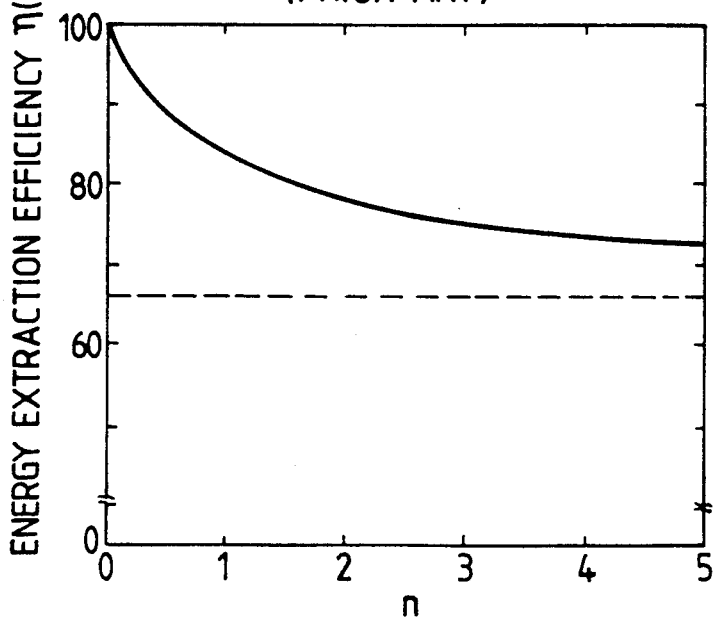
FIG. 3-2 (PRIOR ART)
Figures 1, 5:
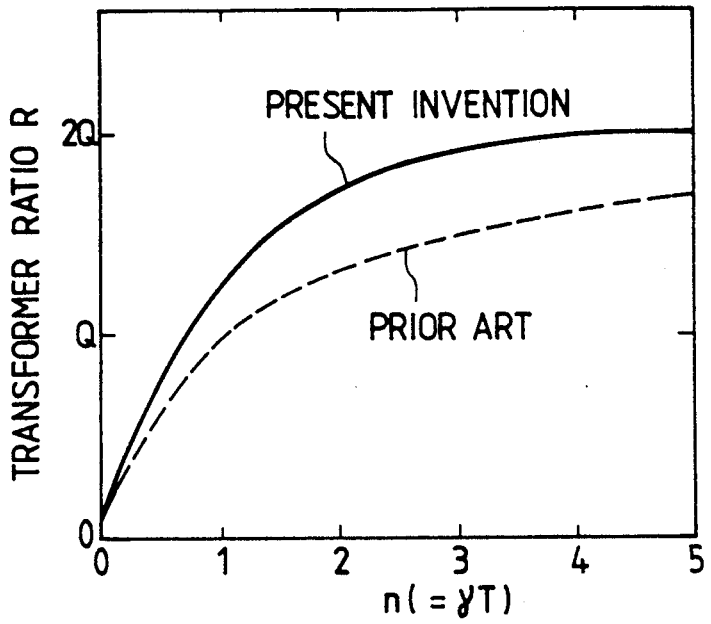
FIGS. 5(1) and 5(2) are diagrams in which the characteristics of the present invention and the prior art are compared.
Figures 2, 5:
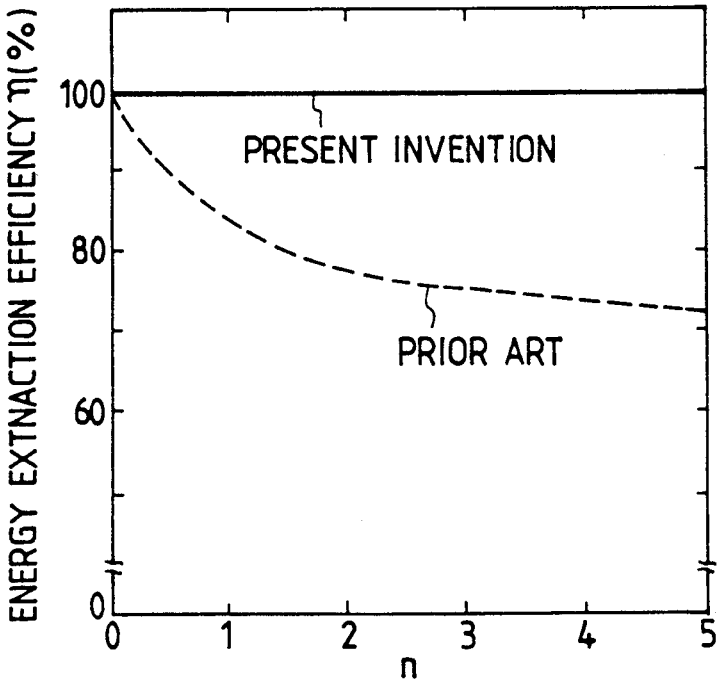

The amount of extraction of electrons which are emitted from the cathode 12 held at a minus high voltage, is controlled by an electric field owing to the grid electrode 10. This control can be performed in such a way that the potential of the grid electrode 10 is controlled by the grid voltage control circuit 11. On this occasion, the current I(t) is conformed to Eq. (7). Thus, a driving electron beam 20 for exciting the wake field is produced. Meantime, a magnetic field is kept generated in the axial direction of the cavity 2 by the focusing coil assembly 3 lest the driving electron beam 20 should become unstable. In order to accelerate an electron bunch to-be-accelerated 21 by means of the excited wake field, the driving electron beam 20 is caused to travel along the axis of the cavity 2, and the electron bunch to-be-accelerated 21 is thereafter projected with the lag of a time interval:

$$t = (\tfrac{1}{4} + 2N)\frac{2\pi}{\omega} \quad (N\text{: plus integer}) \tag{10}$$

which affords the maximum acceleration voltage in the wake field voltage illustrated in FIG. 1. Then, the transformer ratio R of the accelerator of the embodiment can be maximized. In addition, the plus integer N in Eq. (10)

should preferably be set as small as possible. The reason is that, when the plus integer N is too great, an electric discharge is liable to occur on the basis of an intense electric field of high frequency due to the wake field.

The driving electron beam 20 has its trajectory bent by the magnetic field of the bending magnet 5, and is introduced into the collector 4. On the other hand, the electron bunch 21 accelerated to a high energy level by the high voltage of the wake field is influenced by a small amount by the magnetic field of the bending magnet 5 and is guided toward the deriving port 6, whereupon it is supplied for use by the user of the accelerator.

In order to quantitatively grasp the effects of the present invention, the transformer ratio R and the energy extraction efficiency $\eta$ in the present invention will be indicated together with the values of a prior-art example as to a case where the Q-value of the cavity is 6000 and where the resonant frequency f $(=2\pi/\omega)$ thereof is 30 GHz. At n=2, the transformer ratio R is 8000 in the prior-art example, whereas it is 10400 in the present invention, and the energy extraction efficiency $\eta$ is 78% in the prior-art example, whereas it is approximately 100% in the present invention. At n=5, the transformer ratio R is 12000, the maximum realizable value in the present invention in contrast to 10000 in the prior-art example, and the energy extraction efficiency $\eta$ is approximately 100% in the present invention in contrast to 72% in the prior-art example.

As thus far described, this embodiment can provide a wake field accelerator the transformer ratio R and the energy extraction efficiency $\eta$ can be set great.

Moreover, in this embodiment, electrons of high energy can be produced, and they are separated by the bending magnet so as to be supplied to the user. Therefore, an industrial synchrotron light source can have its size reduced much by applying the present invention thereto. More specifically, it has heretofore been common practice that electrons accelerated to a certain degree by a linear accelerator are accelerated to high energy by a synchrotron and are thereafter supplied to a storage ring. In contrast, when the present invention is applied, the electrons can be injected from the wake field accelerator of the present invention directly into the storage ring, and hence, the synchrotron is dispensed with, so that the apparatus is made much smaller.

Figure 7:
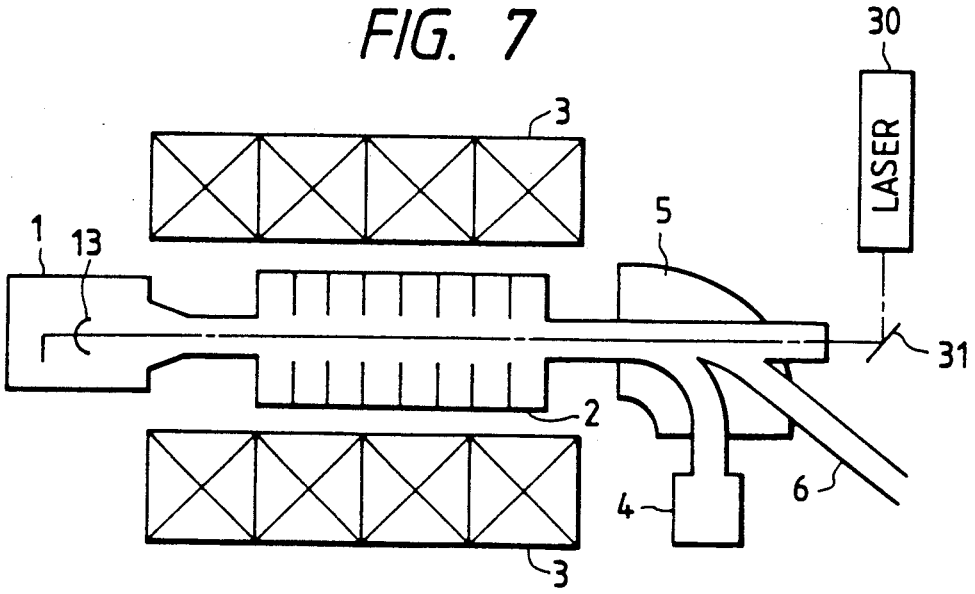

The second embodiment of the present invention will be described with reference to FIG. 7. The points of difference from the first embodiment are that the cathode 12 is replaced with a photocathode 13, that the grid electrode 10 and the grid voltage control circuit 11 are omitted, that a laser 30 and a reflective mirror 31 are installed as shown in the figure, and that the position of the high energy particle extracting port 6 is slightly shifted from the center axis of the cavity 2 with the magnetic field intensity of the deflection magnet 5 somewhat changed. A laser beam from the laser 30 is reflected by the reflective mirror 31, to pass along or near the center axis of the cavity 2 so as to fall on the photocathode 13. On this occasion, photoelectrons are emitted from the photocathode 13, and current flows along the center axis of the cavity 2. Herein, the value of the current is controlled by the quantity of light of the laser beam of the laser 30 so as to change in conformity with or in approximation to Eq. (7). Thereafter, the electron bunch to-be-accelerated 21 is projected with the lag of the time interval of Eq. (10). The others are the same as in the first embodiment of the present invention.

Besides the effects of the first embodiment, this embodiment brings forth the effect that, since the current can be controlled by the laser beam, the control of high speed and little electromagnetic noise is realized.

Figure 8:
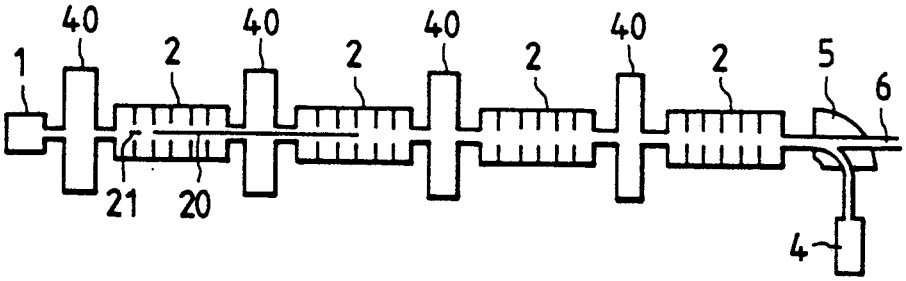

The third embodiment of the present invention will be described with reference to FIG. 8. In this embodiment, a plurality of cavities 2 in which the wake field is excited are arrayed in series. An acceleration unit 40, in which the driving electron beam of low energy 20 for exciting the wake field is intermittently accelerated to resupply energy to the electron beam, is interposed between the electron gun 1 and each cavity 2 or two or more of the cavities 2, thereby resulting in a multistage system.

This embodiment achieves the effect that the electron bunch to-be-accelerated 21 is continuously accelerated over a long distance, whereby it can be endowed with still higher energy.

Figure 9:
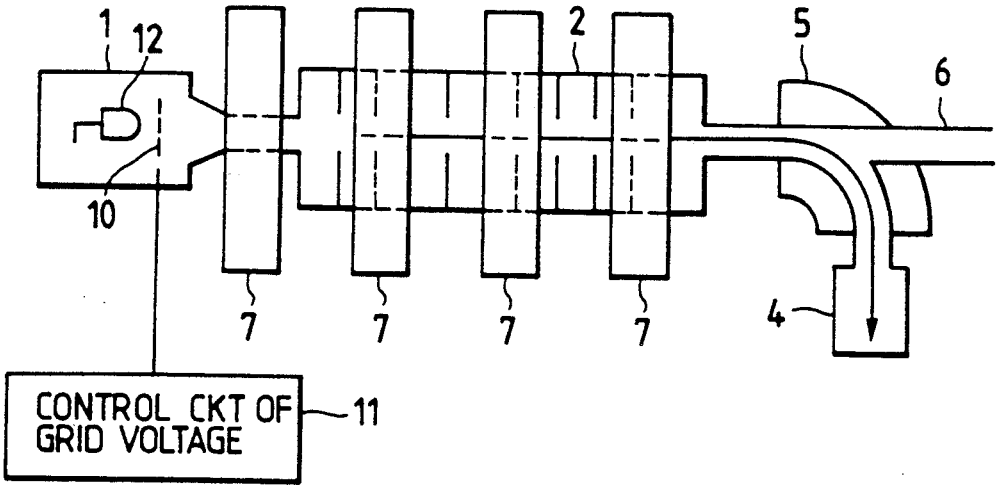

The fourth embodiment of the present invention will be described with reference to FIG. 9. The point of difference from the first embodiment is that a quadrupole magnet assembly 7 of FODO system is employed instead of the focusing coil assembly 3. The FODO system is a system wherein focusing magnets and non-focusing magnets are alternately arrayed. Thus, the embodiment can be endowed with a focusing function similar to that of the focusing coil assembly 3.

This embodiment achieves the effect that the focusing function of good efficiency can be afforded with a smaller amount of coil current.

Figure 10:
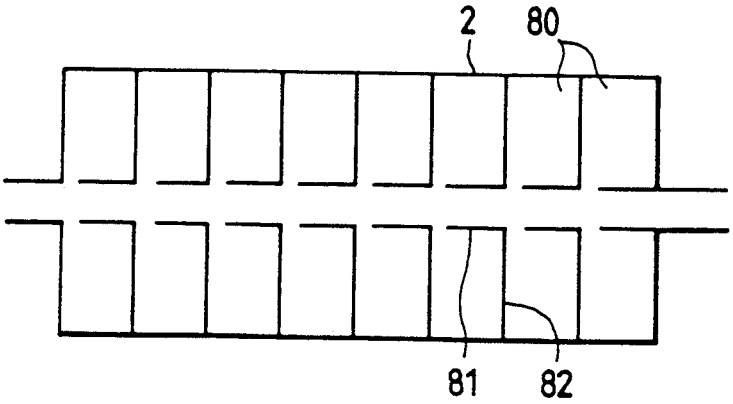

The fifth embodiment of the present invention will be described with reference to FIG. 10. In this embodiment, inside the cavity 2 which is constructed of a plurality of cells 80 and partition plates 82, beam ducts 81 are disposed near the beam trajectory.

This embodiment achieves the effect that the electromagnetic coupling among the plurality of cells 80 lessens owing to the electromagnetic shielding action of the beam ducts 81, to impede the generation of higher-order modes which render the electron beam 20 unstable.

Figure 11:
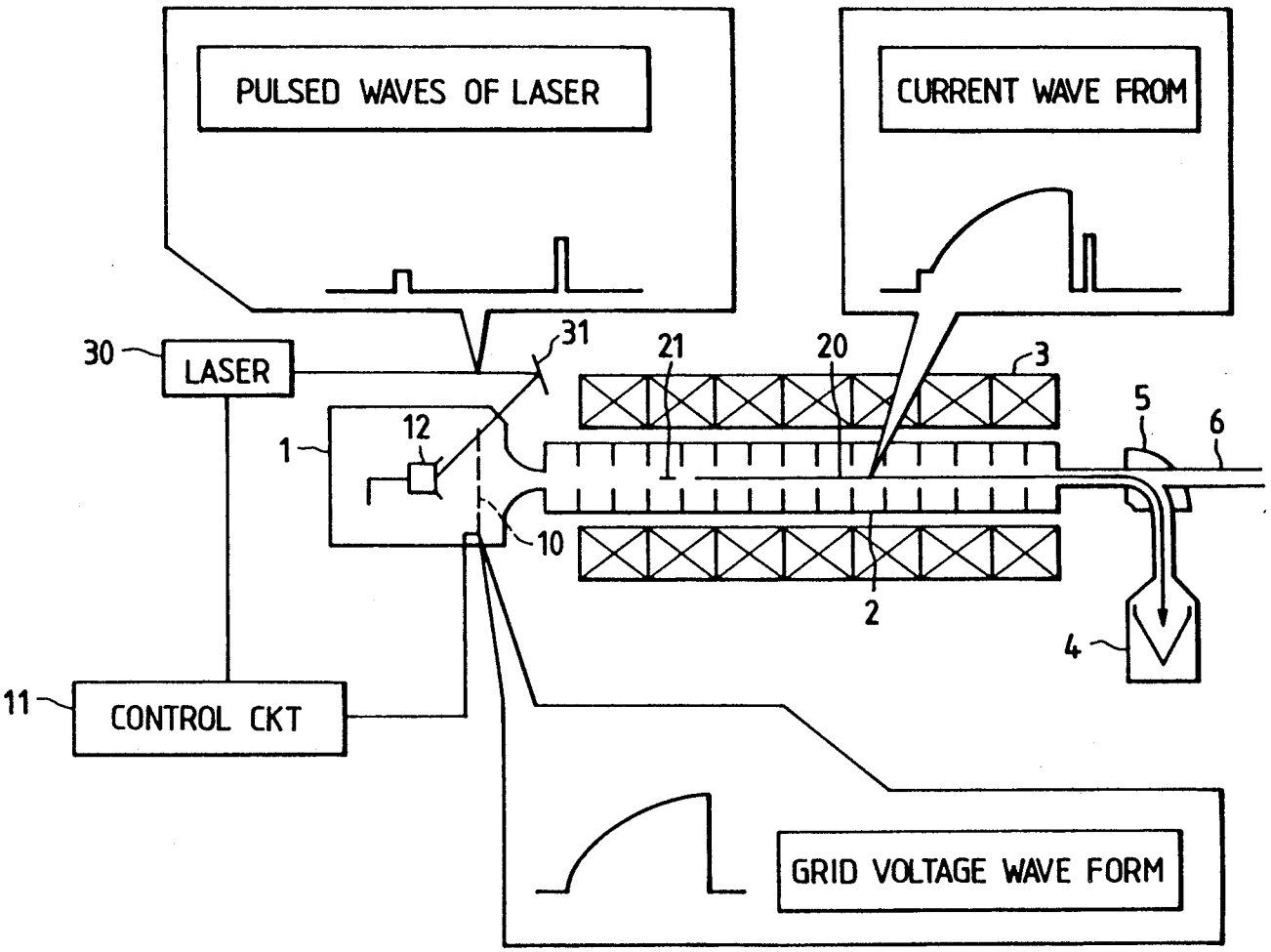

Another embodiment of the present invention is shown in FIG. 11. A laser 30 and a mirror 31 are added to the basic arrangement shown in FIG. 6. In this embodiment, the electron beam to-be-accelerated and the driving electron beam during the initial time interval $$\left(-\frac{\pi}{2\omega} \leqq t \leqq 0\right)$$

of the beam current waveform indicated by Eq. (7) are produced by photoelectrons from the laser 30, and the outer most current is produced in the way that the amount of electrons to be taken out, the electrons being emitted from the cathode 12 held at the minus high voltage, is controlled by the potential of the grid electrode 10.

By assigning the individual functions to the laser 30 and the grid electrode 12 in this manner, the accelerator can be endowed with both the high performance of high-speed switching based on the laser and a great current control based on the grid electrode.

According to the present invention, as described above, a current which is formed by a driving charged particle bunch is controlled so that the driving charged particle bunch may undergo a substantially uniform deceleration voltage. Thus, the invention achieves the following effects:

The transformer ratio R of a wake field accelerator can be heightened. In particular, a high transformer ratio can be realized with a short beam of the driving charged particle bunch, and a transformer ratio of 2.0 which is substantially the highest can be realized at n=5.

Moreover, the energy extraction efficiency $\eta$ of the wake field accelerator can be made approximately 100%.

Lastly, it is possible to provide a wake field accelerator in which the energy extraction efficiency does not lower even when the beam length of the driving charged particle bunch is increased in order to raise the transformer ratio, in other words, even when n is enlarged.

What is claimed is:

1. A wake field accelerator comprising a cavity in which a wake field is excited, and charged particle generation means for generating a driving charged particle bunch for exciting said wake field, said driving charged particle bunch compensating for a joule heat loss caused on a wall surface of said cavity by said wake field and undergoing a substantially constant deceleration voltage, said generation means thereafter generating a charged particle bunch to be accelerated by said wake field, said charged particle bunch to-be-accelerated following said driving charged particle bunch and being accelerated by said wake field.

2. A wake field accelerator according to claim 1, wherein said charged particle generation means generates said charged particle bunch to-be-accelerated at a time equal to ¼ of a cycle determined by a resonant frequency of a fundamental mode of said cavity or at said time plus an integer multiple of the cycle, after said driving charged particle bunch.

3. A wake field accelerator according to claim 1, wherein a plurality of cavities are connected in series, and a means for accelerating said driving charge particle bunch is interposed between said charged particle generation means and the nearest cavity or between the cavities.

4. A wake field accelerator according to claim 1, wherein said charged particle generation means comprises a charged particle emission portion which emits charged particles, a grid electrode by which an amount of the charged particles to flow into said wake field is controlled, and a control circuit which controls said grid electrode.

5. A wake field accelerator according to claim 1, wherein said charged particle generation means comprises a charged particle emission portion which emits charged particles, laser beam projection means for projecting a laser beam on said charged particle emission portion, and means for adjusting and controlling an intensity of said laser beam.

6. A wake field accelerator according to claim 4, wherein said charged particle generation means further comprises laser beam projection means for projecting a laser beam on said charged particle emission portion, and means for adjusting and controlling an intensity of said laser beam.

7. A wake field accelerator comprising a cavity in which a wake field is excited, and charged particle generation means for generating a driving charged particle bunch for exciting said wake field so as to form a current with which energy is stored in said wake field in proportion to time, said generation means thereafter generating a charged particle bunch to be accelerated by said wake field which follows said driving charged particle bunch.

8. A wake field accelerator comprising a cavity in which a wake field is excited, and charged particle generation means for generating a driving charged particle bunch for exciting said wake field in an exponential saturation shape so as to cause said driving charged particle bunch to undergo a uniform deceleration voltage, said generation means thereafter generating a charged particle bunch to be accelerated by said wake field at a time equal to ¼ of a cycle determined by a resonant frequency of a fundamental mode of said cavity or at said time plus an integer multiple of the cycle.

9. A wake field accelerator according to claim 8, wherein said charged particle generation means comprises a charged particle emission portion which emits charged particles, a grid electrode by which an amount of the charged particles to flow into said wake field is controlled, and a control circuit which controls said grid electrode.

10. A wake field accelerator according to claim 9, wherein said charged particle generation means further comprises laser beam projection means for projecting a laser beam on said charged particle emission portion, and means for adjusting and controlling an intensity of said laser beam, and an initial part of a current of said driving charged particle bunch corresponding to a fixed time interval, and said charged particle bunch to-be-accelerated are generated by the use of said laser beam.

11. A wake field accelerator comprising a cavity in which a wake field is excited, and charged particle generation means for generating a driving charged particle bunch for exciting said wake field so as to form a current which initially increases abruptly and thereafter increases slowly, whereby most of said driving charged particle bunch undergoes a uniform deceleration voltage, said generation means thereafter generating a charged particle bunch to be accelerated by said wake field at a time equal to ¼ of a cycle determined by a resonant frequency of a fundamental mode of said cavity or at said time plus an integer multiple of the cycle.

12. A wake field accelerator according to claim 11, wherein said charged particle generation means comprises a charged particle emission portion which emits charged particles, laser beam projection means for projecting a laser beam on said charged particle emission portion, and means for adjusting and controlling an intensity of said laser beam.

13. A wake field accelerator comprising a cavity in which a wake field is excited, and charged particle generation means for generating a driving charged particle bunch so as to form a current according to the following waveform and with which said driving charged particle bunch undergoes a uniform deceleration voltage:

$$I(t) = \begin{cases} I_0 & \left(\text{for } -\frac{\pi}{2\omega} \leqq t \leqq 0\right) \\ I_0\left[1 + \frac{\omega}{\gamma}(1 - e^{-\gamma t})\right] & (\text{for } 0 \leqq t \leqq T) \\ 0 & (\text{for } t > T) \end{cases}$$

where

I(t): the current formed by said driving charged particle bunch, $I_o$: a constant, $\omega$: a resonant angular frequency of a fundamental mode of said cavity, $\gamma$: an attenuation factor based on a conductivity of said cavity, said generation means thereafter generating a charged particle bunch to be accelerated by said wake field at a time equal to $\frac{1}{4}$ of a cycle determined by a resonant frequency of a fundamental mode of said cavity or at said time plus an integer multiple of the cycle.

14. A wake field accelerator according to claim 13, wherein said charged particle generation means comprises a charged particle emission portion which emits charged particles, a grid electrode by which an amount of the charged particles to flow into said wake field is controlled, laser beam projection means for projecting a laser beam on said charged particle emission portion, and means for controlling said grid electrode and an intensity of said laser beam.

15. A wake field accelerator according to claim 14, wherein an initial part of the current of said driving charged particle bunch corresponding to a time interval from $$-\frac{\pi}{2\omega}$$

to 0, and said charged particle bunch to-be-accelerated are generated by the use of said laser beam.

16. A wake field accelerator comprising a cavity in which a wake field is excited, and means for generating a driving charged particle bunch for exciting aid wake field with a current so as to compensate a joule heat loss caused on a wall surface of aid cavity by said wake field, said driving charged particle bunch undergoing a substantially uniform deceleration voltage, whereby said wake field is endowed with an ultrahigh accelerating gradient of 1 GeV/m.

17. An acceleration method for a wake field accelerator, comprising the steps of generating a driving charged particle bunch for exciting a wake field in a cavity so as to compensate for a joule heat loss caused on a wall surface of said cavity by said wake field and to undergo a substantially constant deceleration voltage, and subsequently accelerating a smaller number of charged particles to-be-accelerated by means of said wake field so as to follow up said driving charged particle bunch.

18. An acceleration method for a wake field accelerator as defined in claim 17, wherein a timing for the acceleration of said charged particles to-be-accelerated is set at a time equal to $\frac{1}{4}$ of a cycle determined by a resonant frequency of a fundamental mode of said cavity or at said time plus an integer multiple of the cycle after passage of said driving charged particle bunch.

19. An apparatus comprising means for generating charged particles so as to form a current waveform of exponential saturation type, and means for generating a smaller number of charged particles subsequent to the formation of said current waveform.

20. An apparatus comprising means for generating a bunch of charged particles so as to form a current which initially increases abruptly and subsequently increases slowly, and means for generating charged particles in pulsed fashion subsequent to the generation of said bunch of charged particles.

* * * * *